United States Patent [19]

Kulzer et al.

[11] Patent Number: 4,729,473

[45] Date of Patent: Mar. 8, 1988

[54] PACKAGE FOR USE IN DISPLAYING MERCHANDISE FOR SALE

[75] Inventors: Darrell A. Kulzer, Denver; Martin L. Rohm, Aurora, both of Colo.

[73] Assignee: B & R Plastics, Inc., Denver, Colo.

[21] Appl. No.: 73,073

[22] Filed: Jul. 13, 1987

[51] Int. Cl.[4] ..... B65D 73/00

[52] U.S. Cl. ..... 206/477; 206/480; 206/481; 206/486

[58] Field of Search ..... 206/477, 349, 480, 481, 206/486

[56] References Cited

U.S. PATENT DOCUMENTS

| | | | |
|---|---|---|---|
| 3,423,059 | 1/1969 | Kahn . | |
| 3,927,765 | 12/1975 | Beal . | |
| 4,069,915 | 1/1978 | Schurman . | |
| 4,228,896 | 10/1980 | Wu . | |
| 4,378,068 | 3/1983 | Bell . | |
| 4,450,961 | 5/1984 | Bies et al. . | |
| 4,531,636 | 7/1985 | Salacuse . | |
| 4,634,005 | 1/1987 | Kulzer et al. . | |
| 4,650,074 | 3/1987 | Vosbikian | 206/477 |

*Primary Examiner*—William Price

[57] ABSTRACT

A package for use in displaying merchandise on a display stand wherein the merchandise is securely attached to the package and wherein the merchandise may be actually grasped and felt by the potential purchaser who may even simulate the use of the merchandise.

20 Claims, 8 Drawing Figures

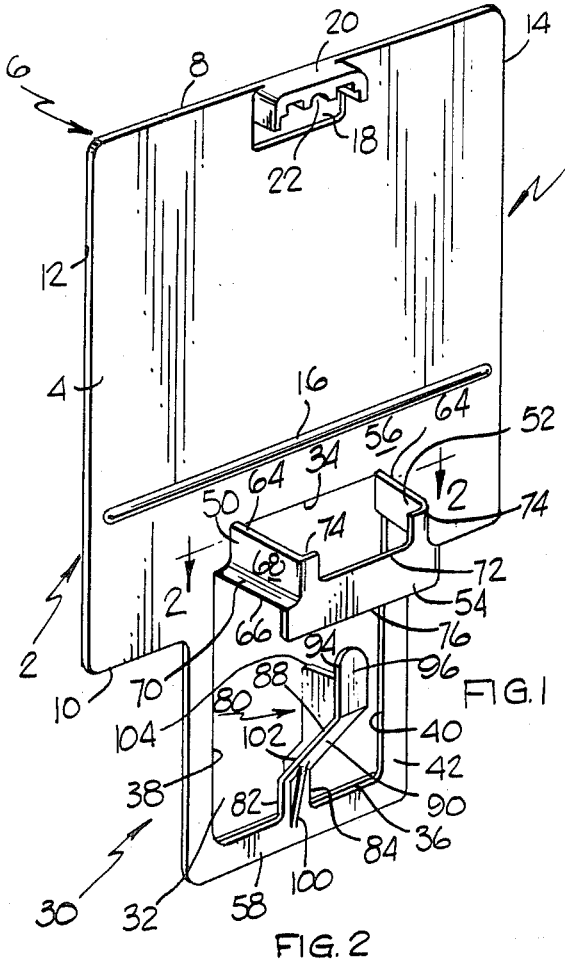
FIG. 1
FIG. 2
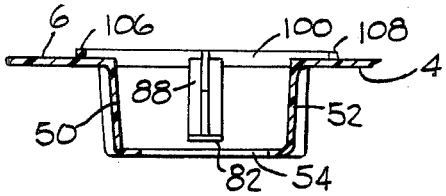
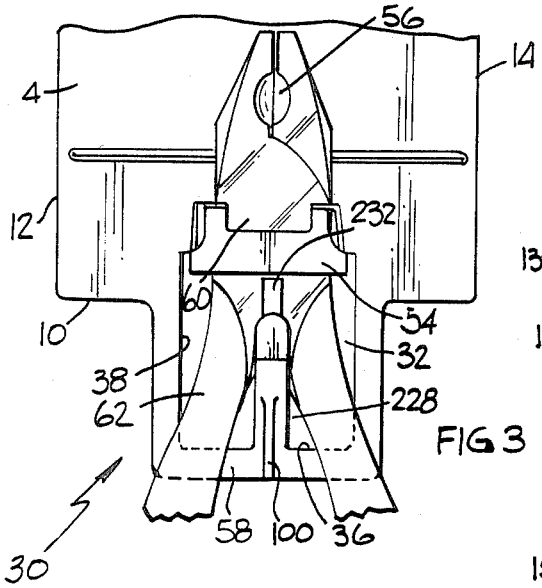
FIG 3
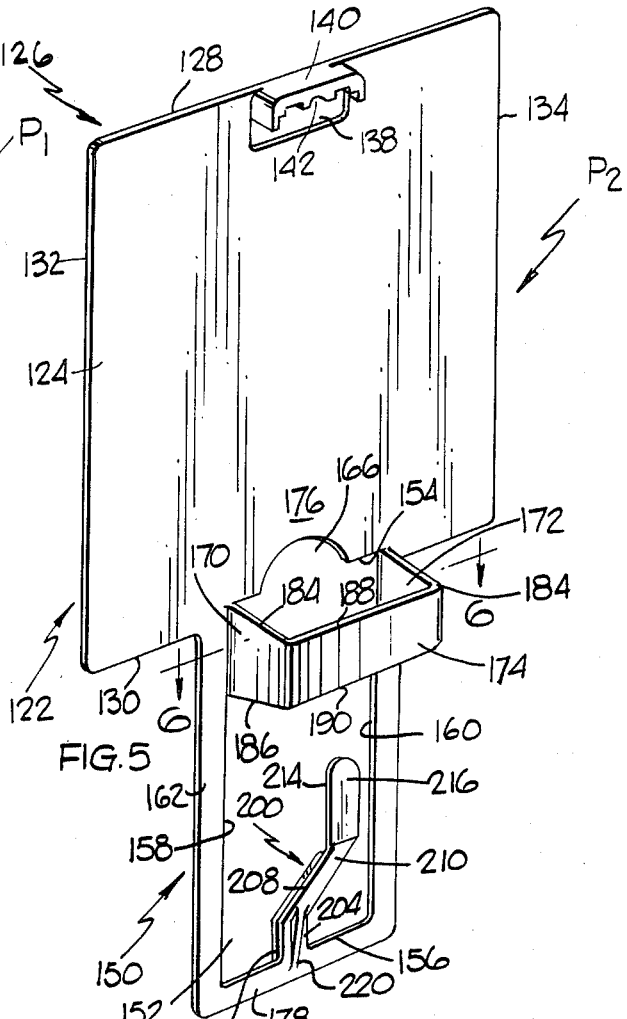
FIG. 5
FIG. 6
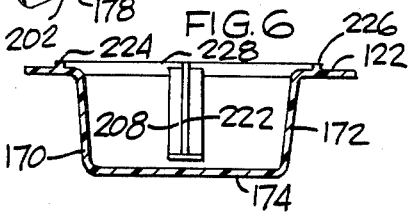
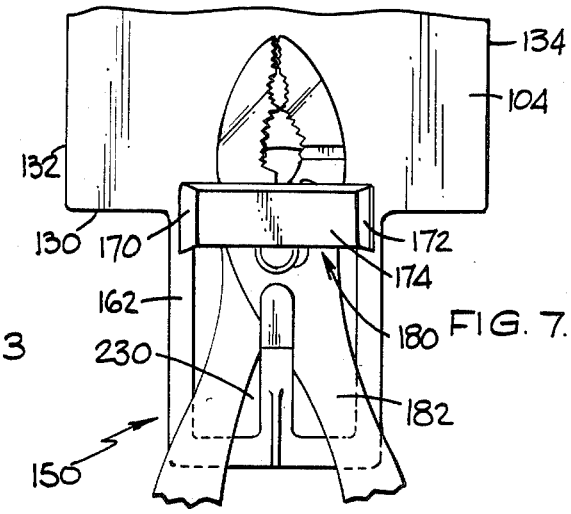
FIG. 7.

PACKAGE FOR USE IN DISPLAYING MERCHANDISE FOR SALE

FIELD OF THE INVENTION

This invention relates generally to the marketing of merchandise to be sold so that the merchandise may be attractively displayed, conveniently stored and easily identified and more particularly to the marketing of tools as durable packages that may be readily displayed, conveniently stored and easily identified.

BACKGROUND OF THE INVENTION

Many manufacturers market merchandise to retailers in packages which allow the retailers to display the merchandise on a plurality of hooks extending outwardly from a surface of a support. These packages have many different forms. One package comprises a flexible plastic bag in which the merchandise is contained which plastic bag is secured to a cardboard holder having an opening so that it may be readily positioned over a hook. Another type of package comprises vacuum forming the merchandise onto a section of cardboard and providing an opening so that the article may be readily positioned on a hook. One of the problems associated with the foregoing packages for marketing merchandise is that the packaged merchandise cannot be really handled and felt by the purchaser. This is particularly important in the marketing of tools, such as a pair of pliers, whereby it would be desirable for the purchaser to be able to grasp the handles and know how the pliers were going to feel when in use. Another problem associates with the foregoing packages relates to the packaging of relatively heavy articles such as tools. It is not unusual for several potential purchasers to remove a packaged merchandise from the display support to examine the merchandise more closely and then return the merchandise to the display support. When the merchandise is relatively heavy, there is a tendency for the cardboard to be damaged to an extent that the package can no longer be mounted on the display support hook. A package particularly suited for use in the marketing of hammers is described in U.S. Pat. No. 4,634,005 to Kulzer et al., which is incorporated herein by reference.

BRIEF DESCRIPTION OF THE INVENTION

This invention relates to a package for marketing merchandise so that it may be attractively displayed, conveniently stored and easily identified and at the same time be readily available to the purchaser so that he can physically grasp the merchandise and feel it and even simulate the use of the merchandise. In a preferred embodiment of the invention, the package is used in the marketing of tools, such as a pair of pliers, and is manufactured as an integrally molded product from a plastic material that when cured is relatively rigid and durable.

In a preferred embodiment of the invention, the package comprises a plate means having generally planar front and rear surfaces and having top and bottom edge portions and two side edge portions. A U-shaped member having generally planar front and rear surfaces is integral with the plate means and extends downwardly therefrom so as to form an inner opening having a continuous edge comprising top and bottom edges and two side edges. A pair of spaced apart projections extend outwardly from portions of the front surface of the plate means contiguous to portions of the side edges. A connecting means extends between and is integral with the pair of spaced apart projections and cooperates therewith and portions of the front surfaces of the plate means and the U-shaped member to form enclosure means for enclosing a portion of the merchandise, such as a pair of pliers. A support prong is integral with a central portion of the bottom edge and extends upwardly in a direction toward the top edge of the continuous edge. The support prong has support means thereon which is contacted by a portion of the merchandise when the support prong is in its supporting location. The integral connection of the support prong to the U-shaped member provides resilient means for permitting displacement movement of the support means of the support prong by a portion of the merchandise as it is inserted through the enclosure means and, after such insertion, the return movement of the support means to its supporting location so that a portion of the merchandise may be contacted and supported by the support means. An opening is provided in the plate means at a location close to the top edge portion so that the packaged merchandise may be displayed by mounting the package on display hook. The package is integrally molded using a high density plastic material, such as polypropylene.

It is an object of this invention to provide a package for use in marketing merchandise wherein the merchandise may be attractively displayed and may be physically grasped and felt by the purchaser and even simulate the use of the merchandise.

It is another object of this invention to provide a package for use in marketing relatively heavy merchandise wherein the merchandise may be attractively displayed but which package is relatively rigid and durable so that it may be repeatedly removed from and returned to a display hook without deterioration.

BRIEF DESCRIPTION OF THE DRAWING

Illustrative and presently preferred embodiments of the invention are shown in the accompanying drawing in which:

FIG. 1 is a front pictorial view of one embodiment of this invention;

FIG. 2 is a cross-sectional view taken on the line 2—2 of FIG. 1;

FIG. 3 is a partial front elevational view illustrating the package holding a pair of electrician's pliers;

FIG. 5 is a front pictorial view of a preferred embodiment of this invention;

FIG. 6 is a cross-sectional view taken on the line 6—6 of FIG. 5;

FIG. 7 is a partial front elevational view illustrating the package holding a pair of conventional pliers.

DETAILED DESCRIPTION OF THE INVENTION

Figure 4:
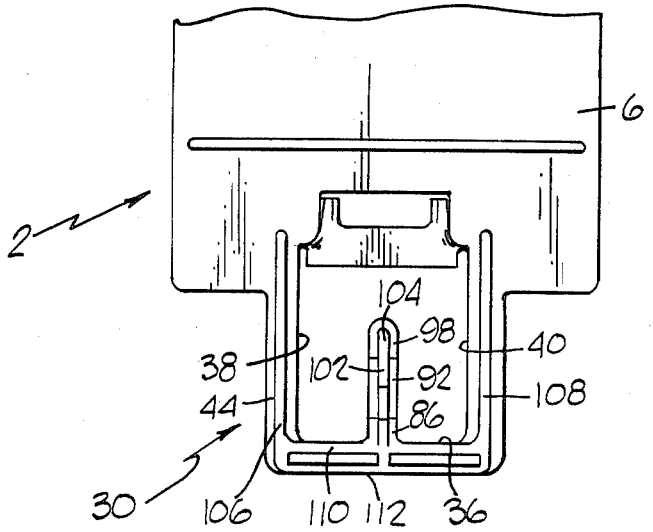
FIG. 4 is a rear elevational view of FIG. 1.

In FIGS. 1–4, there is illustrated one embodiment of the invention and comprises a package P1 comprising a plate means 2 having a generally planar front surface 4 and a generally planar rear surface 6. The plate means 2 has a top edge portion 8, a bottom edge portion 10 and two side edge portions 12 and 14, all of which extend in a linear direction. A reinforcing rib 16 projects outwardly from the front surface 4 and extends in a linear direction between the side edge portions 12 and 14 and is generally parallel to the top and bottom edge portions 8 and 10. The reinforcing rib 16 terminates a short distance away from each of the side edge portions 12 and 14. An opening 18 is formed in the plate means 2 adjacent to the top edge portion 8. An integral flange 20 projects outwardly from the front surface 4 and is provided with a central groove 22 extending therethrough to cooperate in placing the package P1 on a display hook (not shown).

An integral U-shaped member 30 extends downwardly from the bottom edge portion 10 so as to form an inner opening 32 having a continuous edge comprising a top edge 34, a bottom edge 36 and two side edges 38 and 40. The U-shaped member 30 lies in the same plane as the plate means 2. The U-shaped member 30 has a generally planar front surface 42 and a generally planar rear surface 44. As illustrated in FIGS. 1 and 4, a portion of the inner opening 32 is formed by a central cut-out portion of the plate means 2.

A pair of spaced apart, integral projections 50 and 52 extend outwardly from the front surface 4. A connecting means 54 extends between and is integral with the projections 50 and 52 and cooperates therewith and with portion 56 of the plate means 2 and portion 58 of the U-shaped member 30 to form an enclosure means for enclosing a portion 60 of the electrician's pliers 62, as illustrated in FIG. 3. The spaced apart projections 50 and 52 have top edge portions 64 lying in the same plane and bottom edge portions 66 lying in the same plane. Also, the spaced apart projections 50 and 52 have upper portions 68 having generally planar exposed surfaces and lower portions 70 having arcuately shaped exposed surfaces which provide reinforcement therefor. The connecting means 54 has a U-shaped top edge portion 72 with portions 74 thereof lying in the same plane as the top edge portions 64 and a bottom edge portion 76 lying in a plane spaced from the plane of the bottom edge portions 66 and located between the plane of the bottom edge portions 66 and the bottom edge portion 10 of the plate means 2. The distance between the projections 50 and 52 at their juncture with the front surface 4 is greater than the distance between the projections 50 and 52 at their junction with the connecting means 54.

An integral support prong 80 extends upwardly from the bottom edge 36 in a direction toward the top edge 34. The support prong 80 has a first portion 82 having generally planar front and rear surfaces 84 and 86 and lying in the same plane as the U-shaped member 30; a second portion 88 having generally planar front and rear surfaces 90 and 92 and a third portion 94 having front and rear surfaces 96 and 98. The front surfaces 84 and 90 form an obtuse angle of between about 125 and 145 degrees and preferably about 135 degrees. The front surfaces 90 and 96 form an angle of between about 215 and 235 degrees and preferably about 225 degrees. A reinforcing rib 100 extends outwardly from th front surfaces 84 and 90 and is integral therewith and with a portion of the front surface 42. A reinforcing rib 102 is integral with the rear surfaces 86, 92 and 98 and extends inwardly toward the inner opening 32 and includes a support fin 104 for supporting the merchandise.

The back surfaces 6 and 44 are provided with reinforcing rib means comprising a linearly extending reinforcing rib 106 extending outwardly from the back surfaces 6 and 44 and located close to and parallel to the side edge 38; a linearly extending reinforcing rib 108 extending outwardly from the back surfaces 6 and 44 and located close to and parallel to the side edge 40; and a pair of spaced apart, linearly extending reinforcing ribs 110 and 112 extending outwardly from the back surface 44 and located close to and parallel to the bottom edge 36.

In FIGS. 5–8, there is illustrated the preferred embodiment of the invention and comprises a package P2 comprising a plate means 122 having a generally planar front surface 124 and a generally planar rear surface 126. The plate means 122 has a top edge portion 128, a bottom edge portion 130 and two side edge portions 132 and 134, all of which extend in a linear direction. If desired, a reinforcing rib similar to the reinforcing rib 16 of FIG. 1 may be provided on the front surface 124. An opening 138 is formed in the plate means 122 adjacent to the top edge portion 128. An integral flange 140 projects outwardly from the front surface 124 and is provided with a central groove 142 extending therethrough to cooperate in placing the package P2 on a display hook (not shown).

Figure 8:
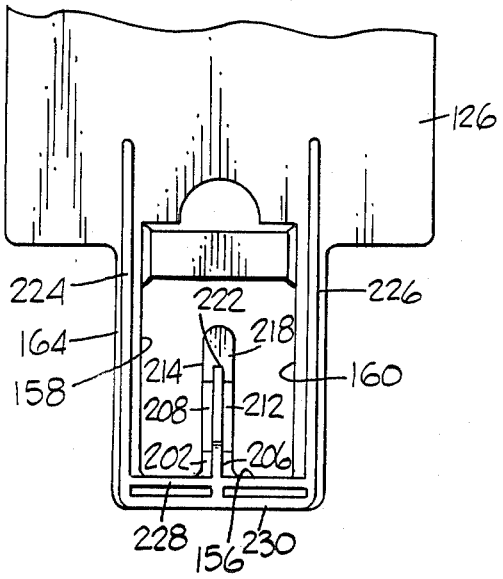
FIG. 8 is a rear elevational view of FIG. 5.

An integral U-shaped member 150 extends downwardly from the bottom edge portion 130 so as to form an inner opening 152 having a continuous edge comprising a top edge 154, a bottom edge 156 and two side edges 158 and 160. The U-shaped member 150 lies in the same plane as the plate means 122. The U-shaped member 150 has a generally planar front surface 162 and a generally planar rear surface 164. As illustrated in FIGS. 5 and 8, a portion of the inner opening 152 is formed by a central cut-out portion of the plate means 122 and includes an arcuately shaped portion 166 for providing space for a portion of the pair of pliers during the insertion thereof.

A pair of spaced apart, integral projections 170 and 172 extend outwardly from the front surface 124. A connecting means 174 extends between and is integral with the projections 170 and 172 and cooperates therewith and with portion 176 of the plate means 122 and portion 178 of the U-shaped member 150 to form an enclosure means for enclosing a portion 180 of the conventional pliers 182 as illustrated in FIG. 7. The spaced apart projections 170 and 172 have top edge portions 184 lying in the same plane and bottom edge portions 186 lying in the same plane. The distance between the top and bottom edge portions 184 and 186 at their juncture with the front surface 124 is greater than the distance between the top and bottom edge portions 184 and 186 at their juncture with the connecting means 174. The top edge portion 188 of the connecting means 174 lies in the same plane as the top edge portions 184 and the bottom edge portion 190 of the the connecting means 174 lies in the same plane as the bottom edge portions 186. The distance between the projections 170 and 172 at their juncture with the front surface 124 is greater than the distance between the projections 170 and 172 at their juncture with the connecting means 174.

An integral support prong 200 extends upwardly from the bottom edge 156 in a direction toward the top edge 154. The support prong 200 has a first portion 202 having generally planar front and rear surfaces 204 and 206 and lying in the same plane as the U-shaped member 150; a second portion 208 having generally planar front and rear surfaces 210 and 212 and a third portion 214 having generally planar front and rear surfaces 216 and 218. The front surfaces 204 and 210 form an obtuse angle of between about 125 and 145 degrees and preferably about 135 degrees. The front surfaces 210 and 216 form an angle of between about 215 and 235 degrees and preferably about 225 degrees. A reinforcing rib 220 extends outwardly from the front surfaces 204 and 210 and is integral therewith and with a portion of the front surface 62. A reinforcing rib 222 integral with the rear surfaces 206, 212 and 218 extends inwardly toward the inner opening 152. The merchandise is supported by the second portion 208.

The back surfaces 126 and 164 are provided with reinforcing rib means comprising a linearly extending reinforcing rib 224 extending outwardly from the back surfaces 126 and 164 and located close to and parallel to the side edge 158; a linearly extending reinforcing rib 226 extending outwardly from the back surfaces 126 and 164 and located close to and parallel to the side edge 160; and a pair of spaced apart, linearly extending reinforcing ribs 228 and 230 extending outwardly from the back surface 164 and located close to and parallel to the bottom edge 156.

In the preferred embodiments of the invention, the package is integrally molded using a high density plastic material such as polypropylene or other similar material. The package has a generally uniform thickness in the range from about 1.0 mm to 3.0 mm. The relative sizes of the various portions of the package may be varied to accommodate different articles of merchandise. For example, the plate means 122 of the package P2, illustrated in FIG. 5, has a length from the top edge portion 128 to bottom edge portion 130 of about 10 cm, a width of about 9.2 cm, the U-shaped member 150 extends downwardly from the bottom edge portion 130 a distance of about 5.5 cm and has a width of about 4.5 cm, the projections 170 and 172 extend outwardly for a distance of about 1.7 cm and the width of the connecting means 174 is about 3.3 cm. The front surface 216 of the third portion 214 lies in a plane that is spaced from the plane of the front surface 162 of the U-shaped member 150 a distance of about 1.2 cm.

The plate means 2 of the package P1, illustrated in FIG. 1, has a length from the top edge portion 8 to bottom edge portion 10 of about 10 cm, a width of about 9.2 cm, the U-shaped member 30 extends downwardly from the bottom edge portion 10 a distance of about 3.8 cm and has a width of about 5.0 cm, the projections 50 and 52 extend outwardly for a distance of about 1.5 cm and the width of the connecting means 54 is about 3.3 cm. The front surface 96 of the third portion 94 lies in a plane that is spaced from the plane of the front surface 42 of the U-shaped member 30 a distance of about 1.3 cm.

In operation, a portion of the merchandise, such as the pair of pliers in FIGS. 3 and 7, is placed against the support prong and a force is applied to deflect the support prong into the inner opening. The merchandise is pushed through the opening between the projections and th connecting means and moved toward the top edge portion of the plate means. As soon as the merchandise provides a space, such as the space 228 or 230 between the handles of the pliers, the support prong, because of its resilient characteristic, moves out of the inner opening and back into its supporting location. The merchandise is then moved in a direction toward the support prong until it is contacted thereby. The merchandise is then packaged for display. In FIG. 3, the electricians pliers 62 are illustrated in an intermediate position and have a slot 232 into which the fin 104 moves when the electricians pliers have been moved into the support position.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A package for use in displaying merchandise in condition for sale comprising:

plate means having a relatively large surface area and having generally planar front and rear surfaces;

said plate means having a top edge portion, a bottom edge portion and two side edge portions;

support means adjacent to said top edge portion so that said plate means can be hung on a hook;

a U-shaped member integral with said plate means and extending downwardly from said bottom edge portion so as to form an inner opening defined by a continuous edge comprising a top edge, a bottom edge and two side edges;

said U-shaped member having generally planar front and rear surfaces;

a pair of spaced apart projections, each of which extends outwardly from at least a portion of one of said front surfaces;

each of said projections being integral with said at least a portion;

connecting means extending between and integral with said pair of spaced apart projections and cooperating therewith and portions of said front surfaces of said plate means and said U-shaped member to form enclosure means for enclosing a portion of the merchandise;

a support prong integral with a central portion of said bottom edge and extending upwardly in a direction toward said top edge;

support means on said support prong adapted to be contacted by a portion of said merchandise to provide a support therefor when said support prong is in its supporting location; and resilient means for permitting displacement movement of said support means from said supporting location through said opening so that a portion of said merchandise may be inserted through said enclosure means, and, after such insertion, return movement of said support means to said supporting location so that a portion of said merchandise is contacted and supported by said support means.

2. A package as in claim 1 wherein:

at least a portion of said opening extends into said plate means.

3. A package as in claim 2 and further comprising:

said U-shaped member having a front surface which is planar with said front surface of said plate means and a rear surface which is planar with said rear surface of said plate means; and reinforcing means on said rear surface of said U-shaped member.

4. A package as in claim 3 and further comprising:

an arcuate cut out portion in said top edge for providing space for a portion of said merchandise during the insertion thereof into said enclosure means.

5. A package as in claim 3 wherein: said top edge of said inner opening is located between said top edge portion and said bottom edge portion of said plate means.

6. A package as in claim 5, wherein said support prong comprises:

a first portion extending upwardly from and integral with said bottom edge and having generally planar front and rear surfaces;

a second portion extending upwardly and outwardly from and integral with said first portion and having generally planar front and rear surfaces;

said front surfaces of said first and second portions forming an obtuse angle therebetween;

a third portion extending upwardly from and integral with said second portion and having generally planar front and rear surfaces; and said front surfaces of said first and second portions forming an angle greater than 180 degrees.

7. A package as in claim 6 wherein:

said first and third portions lie in spaced apart generally parallel planes.

8. A package as in claim 6 and further comprising:

an outwardly extending reinforcing rib integral with a portion of said front surface of said U-shaped member adjacent to said bottom edge, a portion of said front surface of said first portion and a portion of said front surface of said second portion.

9. A package as in claim 8 and further comprising:

an inwardly extending reinforcing rib integral with a portion of said rear surface of said first portion, a portion of said rear surface of said second portion and a portion of said rear surface of said second portion.

10. A package as in claim 9 and further comprising:

a support fin extending inwardly toward said inner opening and integral with portions of said inwardly extending reinforcing rib.

11. A package as in claim 1 and further comprising:

reinforcing rib means integral with portions of said rear surfaces of said plate means and said U-shaped member and projecting outwardly therefrom.

12. A package as in claim 10 wherein:

said top and bottom edge portions extend in a linear direction and are in a generally parallel relationship; and said two side edge portions extend in a linear direction and are in a generally parallel relationship and are perpendicular to said top and bottom edge portions.

13. A package as in claim 11 wherein said reinforcing rib means comprises:

a first pair of spaced apart ribs extending in a linear direction and generally parallel to said two side edge portions and integral with portions of said plate means and said U-shaped member; and a second pair of spaced apart ribs extending in a linear direction and generally parallel to said top and bottom edge portions and integral with portions of said U-shaped member and said first pair of spaced apart ribs.

14. A package as in claim 13 wherein:

said pair of spaced apart projections have top and bottom edge portions;

said connecting means has top and bottom edge portions; and said top edge portions of said pair of spaced apart projections and said connecting means lie in the same plane and said bottom edge portions of said pair of spaced apart projections and said connecting means lie in the same plane.

15. A package as in claim 14 wherein said support prong comprises:

a first portion extending upwardly from and integral with said bottom edge and having generally planar front and rear surfaces;

a second portion extending upwardly and outwardly from and integral with said first portion and having generally planar front and rear surfaces;

said front surfaces of said first and second portions forming an obtuse angle therebetween;

a third portion extending upwardly from an integral with said second portion and having generally planar front and rear surfaces; and said front surfaces of said first and second portions forming an angle greater than 180 degrees.

16. A package as in claim 15 and further comprising:

an outwardly extending reinforcing rib integral with a portion of said front surface of said U-shaped member adjacent to said bottom edge, a portion of said front surface of said first portion and a portion of said front surface of said second portion; and an inwardly extending reinforcing rib integral with a portion of said rear surface of said first portion and a portion of said rear surface of said second portion.

17. A package as in claim 13 wherein:

said pair of spaced apart projections have top edge portions lying in the same plane and bottom edge portions lying in the same plane;

said connecting means having a U-shaped top edge portion with portions thereof lying in the same plane as said top edge portions of said pair of spaced apart projections; and said connecting means having a bottom edge portion lying in a plane spaced from the plane of said bottom edge portions of said pair of spaced apart projections and located between the plane of said bottom edges of said pair of spaced apart projections and said bottom edge portion of said plate means.

18. A package as in claim 17, wherein said support prong comprises:

a first portion extending upwardly from and integral with said bottom edge and having generally planar front and rear surfaces;

a second portion extending upwardly and outwardly from and integral with said first portion and having generally planar front and rear surfaces;

said front surfaces of said first and second portions forming an obtuse angle therebetween;

a third portion extending upwardly from and integral with said second portion and having generally planar front and rear surfaces; and said front surfaces of said first and second portions forming an angle greater than 180 degrees.

19. A package as in claim 18 and further comprising:

an outwardly extending reinforcing rib integral with a portion of said front surface of said U-shaped member adjacent to said bottom edge, a portion of said front surface of said first portion and a portion of said front surface of said second portion;

an inwardly extending reinforcing rib integral with a portion of said rear surface of said first portion, a portion of said rear surface of said second portion and a portion of said rear surface of said third portion;

a support fin extending inwardly toward said inner opening and integral with portions of said inwardly extending reinforcing rib; and a reinforcing rib extending in a linear direction and projecting outwardly from said front surface of said plate means and located between said top edge of said inner opening and said top edge portion of said plate means and providing means to space said merchandise away from said front surface of said plate means.

20. A package as in claim 17 wherein:

each of said pair of spaced apart projections has an upper portion having generally planar exposed surfaces and a lower portion having arcuately shaped exposed surfaces.

* * * * *